United States Patent [19]

MacCarthy

[11] Patent Number: 4,912,849

[45] Date of Patent: Apr. 3, 1990

[54] SKETCHING AND TRACING INSTRUMENT

[76] Inventor: Patrick MacCarthy, 5263 Arbutus St., Arvada, Colo. 80002

[21] Appl. No.: 204,850

[22] Filed: Jun. 10, 1988

[51] Int. Cl.[4] ..... G09F 11/18

[52] U.S. Cl. ..... 33/1 AA; 33/565; 434/88

[58] Field of Search ..... 434/88; 33/27.11, 562, 33/565, 1 AA, 1 G, 1 K; 353/77, 119, 44; 40/361; 350/121, 122

[56] References Cited

U.S. PATENT DOCUMENTS

| | | | |
|---|---|---|---|
| 160,287 | 3/1875 | Shepherd | 434/88 |
| 1,559,665 | 11/1925 | Beery et al. | 434/88 |
| 2,918,732 | 12/1959 | Ortega | 434/84 |
| 3,568,327 | 3/1971 | Furuoka | 33/565 |
| 4,251,920 | 2/1981 | Cassagnes | 33/565 |
| 4,427,387 | 1/1984 | Tomita | 434/88 |
| 4,600,393 | 7/1986 | Rosenwinkel | 434/84 |

FOREIGN PATENT DOCUMENTS

| | | | |
|---|---|---|---|
| 6903950 | 10/1969 | France | 434/87 |

*Primary Examiner*—Harry N. Haroian
*Attorney, Agent, or Firm*—Armstrong, Nikaido, Marmelstein Kubovcik & Murray

[57] ABSTRACT

A tracing instrument for producing symmetrical sketches includes a transparent or translucent base plate, an illuminating source for projecting light through the base plate, and a transparent top plate disposed on an opposite side of the base plate from the illuminating source, and being spaced apart from the base plate such that a narrow space is formed therebetween, and wherein the top plate forms a surface to support a tracing paper or the like for tracing thereon. Further, a mounting piece is provided which has at least a window therein and is insertable in the narrow space between the base plate and the top plate, wherein a seed drawing is positioned at the window such that light from the illuminating source passes through the window and seed drawing to form an image on the tracing paper for tracing. Also, a shifter is provided for shifting the mounting piece with respect to the tracing paper such that the image is projected onto different portions of the paper.

25 Claims, 3 Drawing Sheets

SKETCHING AND TRACING INSTRUMENT

FIELD OF THE INVENTION

This invention relates to the field of sketching devices and toys. More specifically, this invention pertains to a mechanical device for producing symmetrical designs. The objective of the invention is to take any drawing, symmetrical or unsymmetrical, and by subjecting it to various operations to produce therefrom new symmetrical and pleasing designs. The initial drawing may consist of a crude scribble or an irregular blob, but the final design will be aesthetically pleasing because of the symmetry introduced in its generation. The invention provides a means for conducting the following operations in a simple, convenient, and rapid manner that is suitable for use by children, with minimal mechanical or artistic skills: the initial drawing is placed within a sector of a circle whose angle is a submultiple of 180° (or 360° depending on the circumstances). This drawing is traced onto an overlying sheet. The initial drawing is then rotated about the center point of the circle, sector by sector, into the neighboring positions, while the overlying sheet is maintained stationary. Each such rotational step may or may not be accompanied by inversion of the initial drawing. The drawing is traced onto the overlying sheet in each of these positions until all sectors of the circle on the overlying sheet have been covered. The result is a symmetrical design if the sector was of the proper angle.

Another embodiment of the invention allows one to generate borders or repeating, two-dimensional patterns by an analogous set of operations.

BACKGROUND OF THE INVENTION

Sketching is a major activity in the play regime as well as in the education of children. Some children develop artistic talents at an early age while others may never attain a facility for drawing. There are a number of drawing aids on the market which help children to draw pretty pictures and designs. Some of these are marketed as toys although their potential benefits extend beyond the realm of playthings. For example, Binney and Smith (Easton, Pennsylvania) and AMAV Industries (Montreal, Canada) market stencils that can be used to guide a pencil or pen in drawing predetermined designs. The well known toy sold under the Trademark Spirograph ® by Kenner Products (Cincinnati, Ohio) allows a wide range of predetermined designs to be produced.

Another simple way for producing pleasant designs is by means of a kaleidoscope. However, in this case the designs have only an ephemeral existence and appear only as virtual images rather than as concrete drawings.

SUMMARY OF THE INVENTION

The objective of this invention, in part, is to provide a simple means for the rapid production of kaleidoscopic-type drawings. This is accomplished by taking any drawing—referred to hereinafter in this specification as the seed drawing—and mechanically and graphically mimicking the reflections which it would undergo if viewed through a two-mirror kaleidoscope. One of the characteristics of a kaleidoscope is that it produces symmetrical designs from unsymmetrical objects, and that also is a feature of the present invention.

The production of kaleidoscopic-type drawings is a fairly common art activity in elementary schools. The repetition and "reflection" operations in these drawings are accomplished by folding the paper into a number of segments. Kaleidoscopic-type drawings and paintings are discussed and illustrated on pages 109, 117, 173, 174, 176 and 177 of "Through the Kaleidoscope . . . and Beyond" by C. Baker (Beechcliff Books, Annapolis, Maryland, 1987). A book entitled "Kaleidoscopic Designs and How to Create Them" by N. Y. Finkel and L. G. Finkel (Dover Publications, Mineola, New York, 1980) describes the production of kaleidoscopic designs from initial drawings on sectors of a circle. The present invention provides a means for streamlining the procedure of producing kaleidoscopic-type designs, compared with that of Finkel and Finkel, so that the designs are developed conveniently and rapidly. The present invention does not require the use of carbon paper, and also eliminates the alignment or distortion problems discussed in the procedure of Finkel and Finkel. The production of kaleidoscopic-type drawings by methods not discussed by Finkel and Finkel is also discussed here. Designs with kaleidoscopic symmetry can also be produced by folding paper in specific ways and then cutting segments from the folded paper, as illustrated in "Easy-to-Make Decorative Paper Snowflakes" (B. L. Reed, Dover Publications, Inc., Mineola, New York, 1987).

Furthermore, the present invention is not limited to producing kaleidoscopic-type art but can also generate symmetrical designs of a type that cannot be produced by kaleidoscopes.

The present invention and its operation are basically described as follows and a more detailed description is given in a later section. Consider a circular envelope or pocket made from two sheets of opaque material such as cardboard, where a pie-shaped sector has been punched out leaving a transparent "window" in the envelope. Take a piece of paper and draw any type of picture on it, regular or irregular, and place this paper into the envelope so that the seed-drawing, or part of it, is visible through the window in the circular envelope. Now consider a lightbox consisting of a container having a lighted bulb within, and covered at the top with a translucent or transparent screen such as glass or plastic. A second plate of glass or plastic that is transparent lies above the first screen with a small, narrow spacing maintained between both plates. This spacing represents a compartment that is open at one edge and closed elsewhere, into which the circular envelope can be freely slipped and which accommodates the circular envelope snugly. Preferably, the lightbox is designed such that the compartment plates are tilted at an angle such that they are directly facing the user. The design and size of the compartment between the two plates is such that the circular envelope protrudes slightly from the top of the compartment and can be readily rotated by one's fingers. Consider the case where the window is a 60° sector. Marks are placed at 60° intervals on the perimeter of the circular envelope and are labeled 1 through 6. The circular envelope is inserted into the compartment between the two plates and is rotated until the mark for the first sector is aligned with an arrow located on a stationary part of the instrument. A sheet of blank translucent or transparent tracing paper or the like is now clipped onto the upper plate and the portion of the drawing that appears in the sector window is traced onto the blank sheet. The circular envelope is then rotated 120° until the indicator mark for the third sector is at the arrow; that is, the drawing has been shifted from the first 60° sector, has skipped the second sector, and moved into the third sector. The drawing is traced again, and the envelope is then rotated a further 120° to the fifth sector and the tracing is repeated. The circular envelope is then removed from the compartment, is inverted (i.e. turned upside-down) and is reinserted into the compartment. Tracing is then repeated with the seed drawing successively located in the second, fourth and sixth sectors. One has then produced a drawing similar to the image that would be produced in a two-mirror, 60° kaleidoscope. Multiply-colored designs can be produced by starting off with a multiply-colored seed drawing and coloring each segment accordingly, sector by sector. If desired, further coloring may be symmetrically added to the kaleidoscopic design after the above operations have been completed. The design produced by a two-mirror 60° kaleidoscope is characterized by (at least) a 3-fold rotational axis (i.e. the design repeats itself for every one-third of a rotation (120°) about its center and in the plane of the paper); it also has three mirror or reflection planes or lines (i.e. straight lines where the design on one side of the line is the mirror image of that on the other side). Other ways for producing kaleidoscopic-type designs using this instrument are described later in this specification. Kaleidoscopic-type designs can be produced in the above manner when the sector angle is an even submultiple of 360°, i.e. when the angle is 180°, 90°, 60°, 45°, 36°, 30° and so on.

Another type of symmetrical (but non-kaleidoscopic) design can be produced using the 60° sector and tracing the seed drawing onto all six sectors of the overlying paper without any inversions. In this case, the resulting design has a six-fold rotational axis of symmetry, but (in general) has no planes of symmetry perpendicular to the plane of the paper. This type of drawing can be produced when the sector angle is any integral submultiple of 360°, i.e. 180°, 120°, 90°, 72°, 60°, etc.

The present invention can also be used to produce "One-dimensional" (borders) and two-dimensional repeating patterns as will be explained later in this specification.

In accordance with the above-presented summary of the invention, and a further description of the invention which will follow, it is the primary object of this invention to provide a sketching and tracing instrument which allows symmetrical designs to be generated from the initial drawings that are either symmetrical or unsymmetrical.

Another object of this invention is to provide an instrument for the facile production of kaleidoscopic-type drawings.

Another object of this invention is to provide an instrument for the facile production of drawings having rotational but not necessarily mirror symmetry.

Still another object of this invention is to provide an instrument that allows children with little or no artistic talent to produce attractive and pleasing designs.

Another object of this invention is to provide an educational toy that teaches children to recognize symmetry in art and in their surroundings by showing them how to produce various symmetrical designs.

Yet another object of this invention is to provide a free-form sketching aid in which the final designs are determined by the user and are not predetermined by stencils or the like.

Another object of this invention is to provide a sketching and tracing instrument for generating borders and repeating patterns.

Still another object of this invention is to provide a sketching tool that has value in the graphic and decorative arts.

Another object of this invention is to provide a sketching instrument that is very versatile in the types of symmetrical designs that it can produce.

These and other objects and advantages of the present invention will become apparent to those skilled in the art upon reading the details of construction and use as more fully set forth below, reference being made to the accompanying drawings forming a part hereof, wherein like numerals refer to like parts throughout.

DESCRIPTION OF THE PRESENTLY PREFERRED EMBODIMENTS

Before the present invention is described in detailed in terms of its preferred embodiments, it is to be understood that this invention is not limited to the particular arrangements of parts shown, as such devices may, of course, vary. It is also to be understood that the terminology used herein is for the purpose of describing embodiments only, and is not intended to be limiting.

Figure 1:
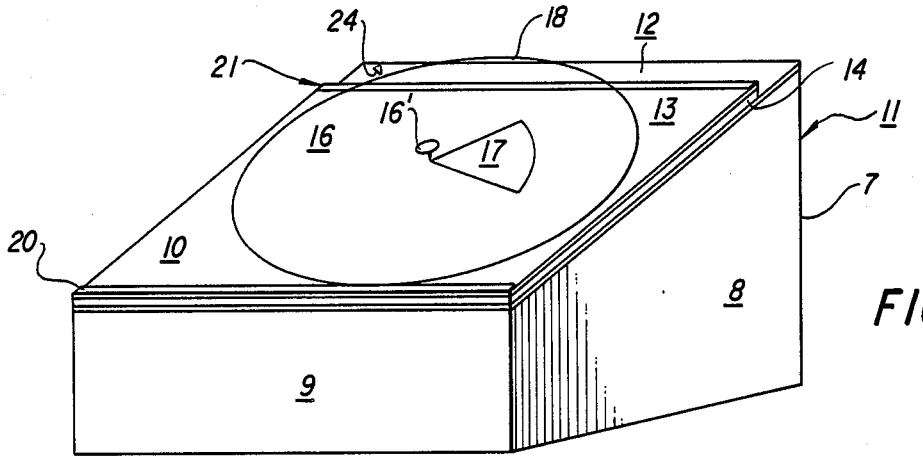
FIG. 1 shows a front perspective view of one embodiment of the sketching and tracing instrument of the present invention.
Figure 2:
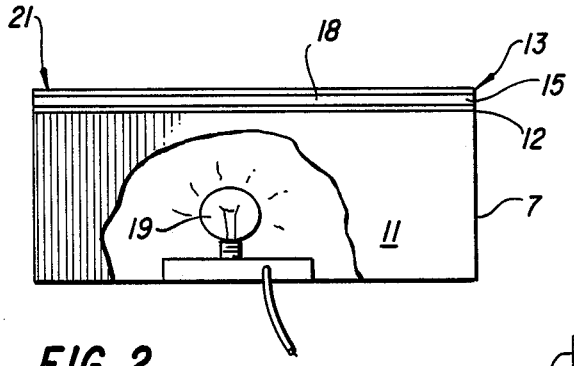
FIG. 2 shows a rear view of FIG. 1.
Figure 3:
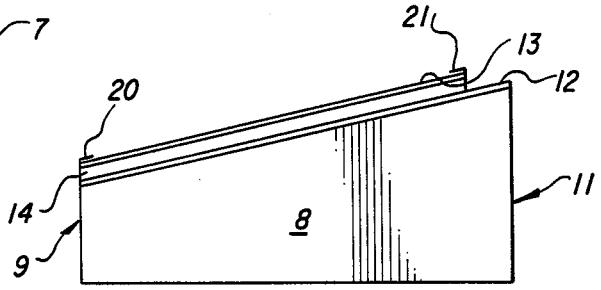
FIG. 3 shows a side view of FIG. 1.

FIG. 1 shows a front perspective view of one embodiment of the sketching and tracing instrument of the present invention. The lightbox 7 having sides 8, 9, 10, 11 is covered by a translucent or transparent base plate 12. A transparent top plate 13 lies above base plate 12 and is separated therefrom by a small, narrow space 14 with an opening 15 as illustrated in FIG. 2, which shows a rear view of FIG. 1. A circular envelope or mounting piece 16 (preferably opaque) with a pie-shaped window 17 cut out of it can be inserted snugly into the space 14. One portion of the envelope 16 protrudes from the opening 15 allowing the envelope 16 to be readily rotated with one's fingers. The edge of the envelope 16 may be serrated to facilitate its rotation by one's fingers. The portions of top plate 13 that are not covered by envelope 16 are preferably opaque or covered with an opaque coating. The rear 11 of the lightbox 7 in FIG. 2 is cut away allowing a lightbulb 19 that is mounted inside to be seen. FIG. 3 shows a side view of the lightbox looking in the direction of side 8. Numerals 20 and 21 designate lips that are attached to plate 13 and extend along the edges of sides 9 and 11, respectively. As is evident from FIG. 3, a sheet of paper can be inserted beneath the lips 20 and 21 which serve to hold the paper to the plate 13. The lips 20 and 21 may serve as clips that hold paper sheets to the plate 13. A pin 16' may be provided at the center of the envelope for the envelope to rotate around.

Figure 4:
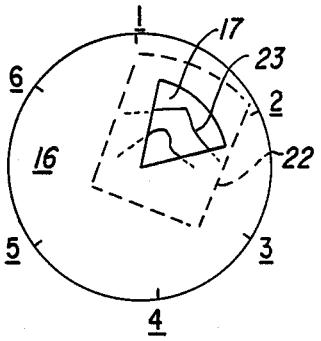
FIG. 4 shows a circular envelope with a 60° sector window.
Figure 5:
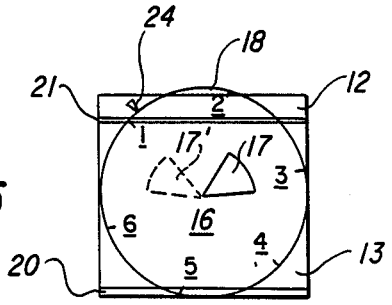
FIG. 5 shows a more detailed view looking down perpendicularly on the plates 12 and 13 of FIGS. 1 and 2.

FIG. 4 shows a circular envelope 16 with a 60° sector 17 cut out. The envelope 16 consists of two sheets of thin, opaque material such as cardboard or plastic that are lying one on top of the other and are joined together. A sheet of paper 22, the outline of which is shown by the broken line in FIG. 4, is inserted between the two walls of the envelope 16. The sheet 22 may contain a drawing 23 part of which is visible in the sector 17. On the perimeter of the envelope 16, the six 60° intervals are marked off and designated by the numerals 1 through 6. The first sector lies between numerals 1 and 2, the second between 2 and 3, and so on. A corresponding set of numerals is indicated on the opposite side of the envelope directly below those shown in FIG. 4. FIG. 5 shows a more detailed view of the instrument from the top looking down perpendicularly on the plates 12 and 13 of FIGS. 1 and 2. An arrow 24 on the plate 12 serves as a reference point with which to align the numerals 1 through 6 that designate the sectors 1 through 6 on envelope 16. FIG. 5 also illustrates a second window 17' which may be used with window 17.

Figure 6:
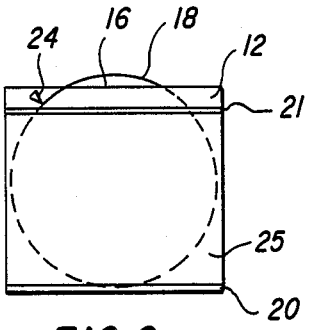
FIG. 6 shows a view similar to that in FIG. 5 except that the sheet for tracing upon has been added.

The instrument is operated as follows: One draws (such as the line 23) on a sheet of paper 22 and inserts this paper into the envelope 16 such that the drawing, or part thereof, is visible in the cut-out sector 17. The envelope 16 containing the paper 22 is then inserted into the space 14 between the plates 12 and 13. Then, a sheet of translucent or transparent paper 25 is inserted under the lips 20 and 21 as shown in FIG. 6. The envelope 16 is rotated with one's fingers by means of the protruding section 18 until arrow 24 on plate 12 is pointing at numeral on envelope 16. With the bulb 19 lighted, one traces the drawing 23 that is visible through the paper 25 onto the paper 25. The envelope 16 is then rotated until the arrow 24 is pointing at numeral 3 on envelope 16 and the tracing is repeated. This is then repeated with the arrow pointing at numeral 5. The envelope 16 is then removed, inverted (i.e. turned upside-down) and reinserted through the slot 15 into the compartment 14 without disturbing the position of the paper 22 relative to the envelope 16. The drawing 23 is also visible through the transparent or translucent sheet 25. The tracing is then repeated with the arrow 24 pointing successively at numerals 1, 3 and 5 on the opposite side of envelope 16. The numerals 1 through 6 appear in exactly corresponding positions on both sides of envelope 16, that is number 1 on one side lies directly above numeral 1 on the other side, and so on. After completing these operations the drawing that was traced onto sheet 25 is identical to the design which would be produced in a 60°, two-mirror kaleidoscope if the segment of the drawing 23 on sheet 22 that lies within the 60° pie sector 17 was placed at the end of the kaleidoscope and aligned within the positions of the mirrors. In this specification, this type of kaleidoscopic design will be said to be directly produced in contrast to the indirectly-produced kaleidoscopic designs that will be discussed later. The symmetrical drawing on sheet 25 can then be removed from the instrument for display.

Many different designs can be produced from a single seed drawing 23 by changing its position and orientation within the envelope 16. Other designs can be produced by changing the seed drawing. The seed drawing may be multiply colored, resulting in a final design that is both symmetrical and colorful. The design produced may be further colored by symmetrical addition of colors after it is produced on the instrument.

Instead of the kaleidoscopic-type designs described above, another type of design (non-kaleidoscopic) with rotational but not reflection symmetry can be produced. In this case the 60° sector is successively moved onto all six positions without inversion, followed by tracing. This gives a design with 6-fold rotational symmetry.

Another way for producing kaleidoscopic-type designs is as follows: The 60° sector is moved successively into all six locations, with tracing at each location; the envelope 16 is then removed, inverted, and reinserted into the compartment 14 where the tracing is repeated at all six sectors. The resulting design in this case is also kaleidoscopic, and corresponds to a design that would be produced in a 30° two-mirror kaleidoscope. This type of kaleidoscopic design will be said to be indirectly produced, in this specification.

The sectors can be at any angle that is a submultiple of 360°, that is, the angle A of the sector is given by the equation $A=360/n$, where n is any positive integer. Only when n is even can kaleidoscopic designs be directly produced, but they can be produced indirectly for both even and odd values of n. The nonkaleidoscopic designs (rotational symmetry only) can be produced for both even and odd values of n. The various circular envelopes can be conveniently designated by the value of n. For example, the envelope with a 90° sector is designated as envelope No. 4 (=360/90), and the envelope with a 60° sector is designated as envelope No. 6, etc., as illustrated in Table 1.

TABLE 1

DESIGNATION OF ENVELOPES BY SECTOR ANGLE

| SECTOR ANGLE(°) | ENVELOPE DESIGNATION |
|---|---|
| 180 | 2 |
| 90 | 4 |
| 72 | 5 |
| 60 | 6 |
| 51.43 | 7 |
| 45 | 8 |
| 40 | 9 |
| 36 | 10 |
| 32.73 | 11 |
| 30 | 12 |
| 27.69 | 13 |
| 25.71 | 14 |
| 24 | 15 |
| 22.5 | 16 |
| 21.18 | 17 |
| 20 | 18 |

A single envelope could contain several cut-out sectors of different angle; alternatively, an envelope may contain a sector with an adjustable angle.

One is not limited to the combination of rotational angles and sector angles mentioned above, although these constitute very important cases. For example, one can produce symmetrical designs by rotating the 60° sector envelope (Envelope No. 6) through 30° angles, and the 30° envelope (Envelope No. 12) through 60°, etc. In fact, one can produce symmetrical designs by rotating a sector of any angle (n not necessarily integral) through angular operations where the angle of rotation is an integral submultiple of 360°. Actually, the symmetry of the final design results not from the shape of the sectors per se, but rather from the nature of the angular operations. In fact, the seed drawing need not be included in a pie-shaped sector at all—any drawing that is subjected to the rotational and inversion operations discussed here will produce symmetrical designs. Rotation about an angle of 180° with inversion produces a simple mirror image (single plane of symmetry) design.

The instrument of the present invention is very versatile in terms of the designs it can produce. For example, in addition to the variables discussed above (i.e. nature of the seed drawing, color(s), orientation and position of seed drawing in envelope, choice of sector angle and rotational angle, direct and indirect kaleidoscopic designs, nonkaleidoscopic symmetrical designs, etc.), the user can determine the size of the design by deciding how far the seed drawing should extend from the center of the working circle.

Another variation involves the producing of designs in the form of rings or circular bands where a given design is confined within specified distances from the center of the circle. Each such ring may have a different type of symmetry, e.g. one ring may have the symmetry of a 60° kaleidoscope, another band may have the symmetry of a 30° kaleidoscope, and still another may have rotational-only symmetry, and so on.

Other variations include the use of "holes" in the envelope that are other than pie-shaped. It should now be evident that the design possibilities with this instrument are endless. The designs that are produced by the instrument of the present invention are free-form; that is, they are determined by the user who draws the initial seed drawing; an extra degree of freedom is provided by choosing the position and orientation of the seed drawing in the envelope. This free-form art is in contrast to drawings produced using stencils or by means of the Spirograph® drawing toy and other such toys where the final design is predetermined by the instrument used. It is also in contrast to art produced by other machines where the design is random in nature, such as the so-called swirl art or the designs made by the "Rainbow Drawing Machine" (Superior Toy and Manufacturing Co., Chicago). This free-form nature of the designs produced by the present invention adds to the educational value and creative aspects of its use.

Figure 7A:
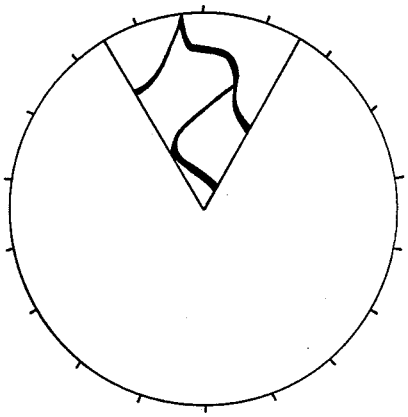
FIG. 7(A–E) show examples of designs that can be produced from a single seed drawing using a 60° sector window.
Figure 7B:
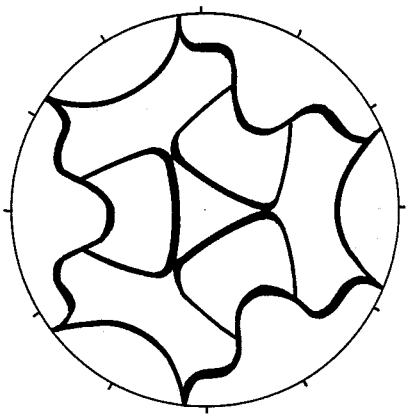
Figure 7C:
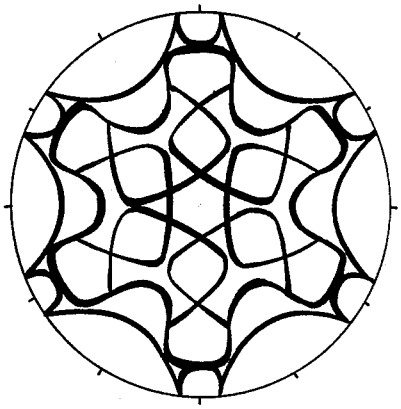
Figure 7D:
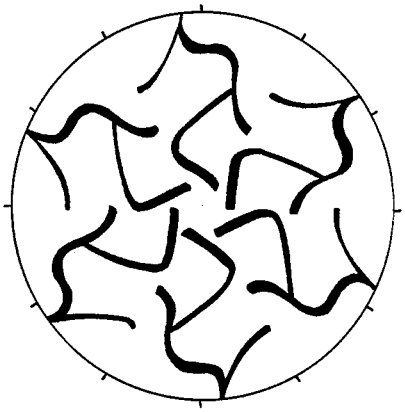
Figure 7E:
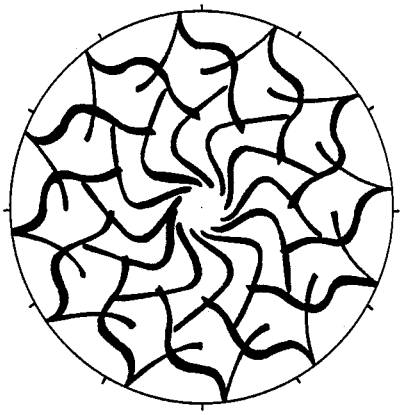

FIGS. 7A–7E show a series of designs produced from a single seed drawing where the seed drawing was maintained in a fixed position in a chosen sector (60°). FIG. 7A shows the seed drawing within the 60° sector envelope; FIG. 7B shows the directly-produced kaleidoscopic design (60° intervals) and FIG. 7C shows the indirectly-produced kaleidoscopic design (60° intervals). FIG. 7D shows a nonkaleidoscopic (rotational symmetry only) design (60° intervals). FIG. 7E shows a rotational-only-symmetry design, with repetition at 30° intervals.

Figure 8A:
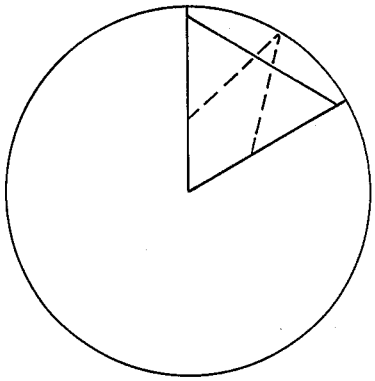
FIG. 8(A–C) shows how star and hexagonal designs can be produced by this instrument.
Figure 8B:
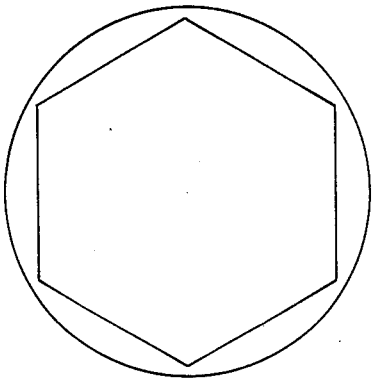
Figure 8C:
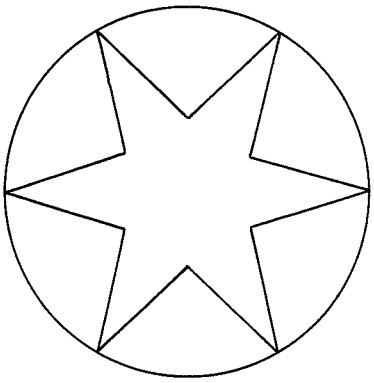

In addition to the random-type seed drawing employed in the above examples, one can also readily generate specific designs such as five-pointed or six-pointed stars, hexagons, snowflakes, flowers, etc. from very simple seed drawings. For example, FIGS. 8B and 8C show how a hexagon and a star are produced from the continuous and dotted straight lines, respectively, of the seed drawing shown in FIG. 8A. In addition, one could use recognizable forms such as plants, animals, buildings etc. as the seed drawings to produce interesting designs from familiar objects taken from magazines, newspapers, etc.

In the development of this invention, a number of problems were encountered in trying to obtain a clear image of the seed drawing for purposes of tracing. When a sheet of white paper, such as typing paper, or photocopy paper with a drawing on it is placed on a lightbox and another sheet of similar paper is placed upon the first, the drawing and its color(s) are generally clearly visible through the upper sheets. If, however, the upper sheet is separated from the lower sheet by the presence of a transparent glass plate positioned therebetween, the image of the drawing that is observed is frequently very blurred and is not of acceptable quality for comfortable use in the present invention. For example, if the transparent plate 13 in FIGS. 1, 2 and 3 is 2.6 mm or more in thickness it is found that the "image" arising from the seed drawing in compartment 14 and as seen through the paper 25 (e.g. Nekoosa brand white paper No. 751-001-0 of 75 g/m$^2$; Nekoosa Paper, Inc., Port Edwards, Wisconsin) is too blurred to be useful. This problem does not arise if the sheet 25 is transparent rather than being just translucent. However, for this invention it is desirable (although not necessary) that the final design appears on paper rather than on transparent plastic, and various methods were investigated to eliminate the above problem. It was found that when the thickness of plate 13 was reduced to 12 mm the clarity of the transmitted image was much improved, but still not acceptable; and when the thickness of plate 13 was further reduced to 0.8 mm, the clarity of the image improved even further and was quite acceptable. Thinner, transparent plates led to even greater clarity of the image as seen through the Nekoosa and other white papers.

In addition, various types of tracing paper were evaluated for drawing upon. Some relatively expensive tracing papers (e.g. Clearprint®, Emeryville, California) did not produce an image of sufficient clarity to be useful with the 2.6 mm plate; other quite expensive tracing "paper" such as Mylar tracing "paper" produced very clear images, even through the 2.6 mm transparent plate. However, certain quite inexpensive tracing papers produced remarkably good results with the 1.2 mm transparent plate. For example, Academie™ Tracing Pad No. 54200 (Mead Corporation, Dayton, Ohio) and PRO ART™ 25# tracing paper, No. 0210-04 (PRO ART, Beaverton, Oregon) produced excellent results in conjunction with the 1.2 mm transparent plate 13.

In addition to allowing the production of clear images, the tracing paper has a number of other advantages:

(a) one can view the final drawing equally well from both sides of the tracing paper;

(b) the drawings look particularly attractive on tracing paper; and (c) the tracing paper (unlike most paper sheets) is totally impervious to permanent felt tip markers which are suitable for use with this invention.

It is possible to use the present invention without a built-in light source, but the inclusion of a light source adds considerably to its quality. The light source may be an incandescent or fluorescent lamp, and may be battery-operated or may work from the mains. The inside walls of the container 7 may be silvered to increase their reflectivity and maximize the illuminating power of the lamp. The lightbox may also contain a compartment for storing pens, paper, the circular envelopes, etc.

The discussion so far in this specification has focused upon the generation of designs having rotational and/or reflection symmetry, such as those found in many ornamental motifs, stained glass windows, etc. Other embodiments of this invention relate to producing patterns having repeating designs such as those found in borders, wallpapers, carpets, tiled floors, etc. For example, many patterns consist of basic design units or motifs that are repeated in one direction (borders) or in two directions. There are various "rules" for generating borders and two-dimensional patterns. Some borders are generated by simply translating a "base design" causing a repetition of the "base design" at regular intervals. In this specification, the term "base design" is used to describe the seed drawing for generating borders and two-dimensional patterns. Other border patterns may involve rotation or reflection in addition to the translational operation. Two-dimensional patterns (such as those on wallpapers) involve translation of the "base design" in two directions and may also involve some elements of rotation or reflection. In the case of borders and two-dimensional patterns the "base design" may have no symmetry elements or it may have a high degree of symmetry.

Figure 9:
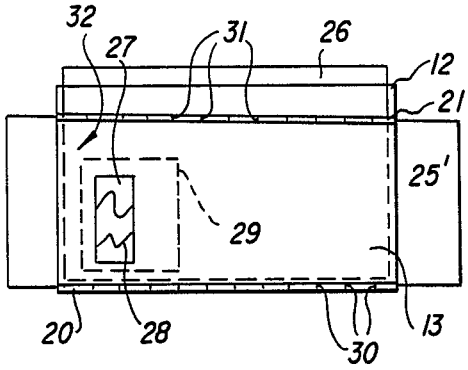
FIG. 9 shows an embodiment of the invention for generating borders and two-dimensional patterns.

The instrument of the present invention may be used in the following manner for generating borders: In this case the envelope that holds the seed drawing (which is now also the "base design") may again be circular or it may be rectangular and not capable of rotating within the compartment 14. FIG. 9 shows a top view of an embodiment containing a rectangular envelope 26 with a rectangular window 27 punched out. In the embodiment considered here the upper sheet 25' is moved during the design generation, rather than moving the envelope; however, this is not necessarily the only mode of operation and other embodiments may involve movement of the envelope rather than the sheet 25'. It is the relative movement between these two elements that is important. Part 28 of a "base design" on paper 29 is visible through the rectangular window 27. The envelope is inserted into the compartment between the two plates 12 and 13 and a sheet of paper 25' is clipped onto the upper plate 13. Sets of indicator marks 30 and 31 are positioned at regular intervals along lips 20 and 21, respectively. Arrow 32 is located on sheet 25' and positioned at one of the markers on lip 20 or 21. The "base design" is then traced onto the upper sheet 25'. The sheet 25' is then moved so that the arrow 32 is pointing at another marker point and the tracing is repeated. This process is repeated at regular intervals producing a border design having translational symmetry only, assuming that the "base design" did not have any symmetry elements of its own. The nature of the border design can be varied by varying the frequency of repetition.

Another type of border design can be produced by going through the above sequence of operations, followed by removal of the envelope from the compartment 14, inversion from side-to-side (i.e. the base design is turned upside-down and positioned with its "old" left hand side on the right hand side), reinsertion into the compartment 14, and repetition of the tracing operations at regular intervals, using the same arrow 32 as a marker. A border design having translational symmetry and mirror symmetry elements transverse to the repeating direction of the design is produced in this case.

Another method consists of the previous set of operations except that inversion of the envelope occurs top-to-bottom (rather than side-to-side). In this case (and in the next case) it is imperative that the rectangular window 27 be positioned exactly halfway, top-to-bottom of the envelope. This produces a border design that has translational symmetry and a plane of symmetry lengthwise of the design.

A border design having translational symmetry and 180° rotational symmetry is obtained by carrying out the above set of operations where the envelope is rotated 180° (i.e. a combination of top-to-bottom and side-to side inversions).

Other types of border designs may also be produced with this instrument; for example, consider that instead of positioninq the window exactly half-way top-to-bottom of the envelope, one end of it lies exactly at the halfway line of the envelope. In this case, the designs that involve top-to-bottom inversion of the envelope will consist of borders that are twice as wide (top-to-bottom) as the window itself and the border will consist of two adjacent, parallel strips. Window designs other than rectangular may also be used. A single envelope may contain several windows of different sizes and shapes, or an adjustable window.

This instrument can produce two-dimensional patterns in several ways. A two dimensional pattern consists of "cells" that repeat in two directions and their generation can be considerably more time-consuming than the designs discussed thus far in this specification. The production of two-dimensional patterns represents a more advanced use of the present instrument. One convenient and relatively rapid way for producing two-dimensional patterns with the instrument of the present invention is as follows: A border-type design is first produced using one of the modes described above. This border-type design is then used as the base design for generating the two-dimensional pattern using, for example, a rectangular window. The envelope containing the drawing is then placed in the compartment 14 with the border extending lengthwise from the top to the bottom of the compartment. By repetitively tracing this border in a direction orthogonal to the direction of the border onto adjacent sections of a new overlying sheet, a two-dimensional pattern is obtained. Different types of two-dimensional patterns with different types of symmetries are produced depending on whether the base design is inverted in any of a variety of ways or combinations prior to successive tracings.

The present invention can be used to produce two-dimensional patterns in various other ways also. For example, a motif may be produced using the circular envelope; such a motif may have kaleidoscopic or rotational-only symmetry as described earlier. This motif may then be used as the base design for producing a border-type design, and this border-type design may, in turn, be used as the base design for producing a two-dimensional pattern.

Half-drop patterns (brick designs) or other fractional drop patterns may also be produced using this invention. The user may use his/her creativity for developing many other types of designs with this instrument.

Other modifications of this invention may involve drawing the seed drawing on an erasable screen and/or tracing the final design onto an erasable screen. Also, instead of inserting the seed drawing between the two walls of an envelope the seed drawing may be taped to or clipped onto a stiff cardboard or plastic sheet that takes the place of the envelope. In this specification, the discussion of the production of kaleidoscopic designs, and other designs with rotational symmetry, involved rotation of the envelope while the upper sheet of paper for tracing upon was held stationary; alternatively, it is possible to produce these designs by maintaining the seed drawing stationary while the upper tracing sheet is rotated and inverted, etc. It is also an obvious extension of this invention to produce a projection version for projecting the designs onto a wall or a screen; this could involve an overhead projector for displaying the final design or some other means of projection. One purpose of the transparent plate 13 (FIGS. 1, 2, 3, 5, 6 and 7) is to provide a flat surface to facilitate tracing on sheet 25 (FIG. 6) or 25' (FIG. 7); however, it is also possible to have an embodiment of the present invention where the plate 13 is absent, and the sheet 25 or 25' lies directly on the envelope 16 or 26, respectively. Furthermore, other embodiments may involve rotation of the envelope 16 about a centrally-located pin 16' which serves as a pivot. The body of the lightbox 7 can be made from wood, plastic, metal or other suitable material; the transparent or translucent sheets can be made from glass or plastic or other suitable material. The sheet having the seed drawing and the sheets for drawing upon may consist of paper, plastic, cloth or other suitable material.

The instant invention is shown and described in what is considered the most practical and preferred embodiments. It is recognized, however, that departures may be made therefrom, that such departures are within the scope of this invention, and that obvious modifications will occur to one skilled in the art upon reading this disclosure.

I claim:

1. A tracing instrument for producing symmetrical sketches from a symmetrical or non-symmetrical seed drawing, comprising:

a transparent or translucent base plate;

an illuminating means for projecting light through said base plate;

a transparent top plate disposed on an opposite side of said base plate from said illuminating means, and being spaced apart from said base plate such that a narrow space is formed therebetween, wherein said top plate forms a surface to support a tracing paper or the like for tracing thereon;

a mounting piece having at least a window therein and being insertable in said narrow space between said base plate and said top plate, wherein the seed drawing is positioned at said window in fixed relationship to said mounting piece, such that light from said illuminating means passes through said window and seed drawing to form an image on the tracing paper for tracing; and means for shifting said mounting piece together with said seed drawing positioned at said window with respect to said tracing paper such that said image is projected onto different portions of the paper.

2. The tracing instrument of claim 1, wherein said mounting piece is an envelope having two walls and said window is formed at corresponding positions in each wall, such that the seed drawing is insertable between said walls.

3. The tracing instrument of claim 1, wherein said mounting piece has a plurality of windows.

4. The tracing instrument of claim 1, wherein said window is a pie-shaped window.

5. The tracing instrument of claim 2, wherein said envelope is a generally circular envelope and is rotatable within said narrow space.

6. The tracing instrument of claim 5, wherein said shifting means includes an opening formed between an edge of said top plate and said base plate, such that said envelope is insertable through said opening to said narrow space, and such that a portion of the envelope extends beyond said edge of said top plate, so that said envelope may be rotated by hand.

7. The tracing instrument of claim 2, wherein said envelope is a generally rectangular envelope.

8. The tracing instrument of claim 1, wherein said window has an adjustable shape.

9. The tracing instrument of claim 4, wherein said pie-shaped window has an angle which is a submultiple of 360°.

10. The tracing instrument of claim 7, wherein said rectangular envelope is linearly shiftable with respect to said tracing paper.

11. The tracing instrument of claim 1, wherein said top plate has a pair of lips at opposite edges to form a guide for the tracing paper positioned on the top plate.

12. The tracing instrument of claim 11, wherein said lips are clips for holding the tracing paper in position.

13. The tracing instrument of claim 1, further comprising a lightbox for supporting said base plate.

14. The tracing instrument of claim 13, wherein said illuminating means includes a light source provided in said light box.

15. The tracing instrument of claim 14, wherein external power is supplied to said light source.

16. The tracing instrument of claim 5, wherein said circular envelope has predetermined positions marked on the periphery thereof for aligning said positions individually during tracing with an index point marked on the top plate or base plate.

17. A tracing instrument for producing symmetrical sketches from a symmetrical or non-symmetrical seed drawing, comprising:

a translucent or transparent base plate;

an illuminating means for projecting light through said base plate;

a shiftable mounting piece having at least a window therein, and wherein the seed drawing is positioned at said window in fixed relationship to said mounting piece, such that light from said illuminating means passes through said window and seed drawing to form an image on a tracing paper or the like, which is disposed on an opposite side of said base plate from said illuminating means, for tracing thereon.

18. A method for tracing symmetrical sketches on a tracing paper or the like from a symmetrical or non-symmetrical seed drawing wherein the tracing paper is positioned on top of a device having a transparent or translucent base plate, a light source for projecting light through the base plate, a transparent top plate disposed on an opposite side of the base plate from the light source, forming a narrow space between the base plate and the top plate, and a mounting piece having at least a window therein and being insertable in the narrow space between the top and base plates wherein the seed drawing is positioned at the window and in fixed relationship to the mounting piece, said method comprising the steps of:

projecting light from said light source through said seed drawing and said window to form an image on the tracing paper;

tracing said image onto the tracing paper;

shifting said mounting piece including said seed drawing a predetermined amount such that said image is formed on a different portion of the tracing paper; and tracing the image onto the different portion of the tracing paper.

19. The method of claim 18, further comprising the steps of:

turning over the mounting piece such that a mirror image of the seed drawing is formed on the tracing paper; and tracing the mirror image of the seed drawing onto the tracing paper.

20. The method of claim 19, wherein said mounting piece is circular and tracing a plurality of tracing steps with the circular mounting piece rotated alternating submultiple angles of 360°;

turning over the mounting piece;

tracing a plurality of tracing steps with the circular mounting piece rotated in alternating submultiple angles of 360° which were not used in the above tracing step.

21. The tracing instrument of claim 1, wherein one of said base plate and said top plate ha a fixed index mark.

22. The tracing instrument of claim 21, wherein said mounting piece has regularly spaced index marks at its periphery and on both sides thereof for alignment with said fixed index mark, as the mounting means is shifted.

23. The tracing instrument of claim 1, wherein said mounting piece is reversible, such that it may be removed from said narrow space, inverted and reinserted into said narrow space.

24. The tracing instrument of claim 1, wherein said mounting piece is generally circular in shape, and is rotatable within said narrow space.

25. A tracing instrument for producing symmetrical sketches from a symmetrical or non-symmetrical seed drawing, comprising:

a transparent or translucent base plate;

a transparent top plate disposed on top of said base plate, and being spaced apart from said base plate such that a narrow space is formed therebetween, wherein said to plate forms a surface to support a tracing paper or the like for tracing thereon;

a mounting piece having at least a window therein and being insertable in said narrow space between said base plate and said top plate, wherein the seed drawing is positioned at said window in fixed relationship to said mounting piece, such that light can pass from said base plate through said window, seed drawing and top plate to form an image on the tracing paper for tracing; and means for shifting said mounting piece together with said seed drawing, positioned at said window, with respect to said tracing paper such that said image is projected onto different portions of the paper.

* * * * *